US005182815A

United States Patent [19]

Young

[11] Patent Number: 5,182,815

[45] Date of Patent: Feb. 2, 1993

[54] ATHLETIC PANTS

[76] Inventor: Margaret B. Young, 75 Deerpath, Oldsmar, Fla. 34677-0000

[21] Appl. No.: 709,500

[22] Filed: Jun. 3, 1991

[51] Int. Cl.[5] ..... A41B 9/02

[52] U.S. Cl. ..... 2/406; 2/228; 2/238; 450/122; 450/123; 450/124; 450/125; 450/126; 450/130; 450/131; 450/133; 450/117

[58] Field of Search ..... 2/406, 228, 238; 450/122, 123, 124, 125, 126, 130, 131, 133, 117

[56] References Cited

U.S. PATENT DOCUMENTS

| | | | |
|---|---|---|---|
| 2,838,761 | 6/1958 | Title | 2/406 |
| 2,852,780 | 9/1958 | Gold | 2/406 |
| 2,905,947 | 9/1959 | Rosenberg | 2/406 |
| 3,005,459 | 10/1961 | Geissman | 450/117 |
| 3,142,301 | 7/1964 | Erteszek | 2/406 |
| 3,490,075 | 1/1970 | Abbott | 2/406 |
| 3,871,030 | 3/1975 | Green | 2/238 |
| 4,355,425 | 10/1982 | Jones et al. | 2/406 |
| 4,538,615 | 9/1985 | Pundyk | 450/131 |

*Primary Examiner*—Werner H. Schroeder

*Assistant Examiner*—Gloria Hale

*Attorney, Agent, or Firm*—Dominik, Stein, Saccocio, Reese, Colitz, & Van Der Wall

[57] ABSTRACT

Athletic pants comprising in combination a plurality of basic panels extending from an upper edge at the front of the wearer's waistline, downwardly around the wearer's crotch, then upwardly to the back of the wearer's waistline and stitched together from the front waistline to the rear waistline, the basic panels being fabricated of a knit fabrication from extensible yarn; an elastic waistband coupled to the upper edge of the basic panels; a pair of support panels located interior of the basic panels and stitched thereto, the base panels being constructed of a knit fabric from extensible yarn and with the support panels also being constructed of a knit fabric from an extensible yarn with the mesh of the support panels being of a greater elasticity than that of the basic panels; and a pair of pocket panels stitched over the sides of the base panels in an inverted U-shape configuration and with an extensible lower edge having an elastomeric hem at its lower edge thereof.

10 Claims, 9 Drawing Sheets

ATHLETIC PANTS

BACKGROUND OF THE INVENTION

1. Summary of the Invention

This invention relates to athletic pants and, more particularly, to single layer tennis pants formed of panels knitted from elastomeric yarn.

2. Description of the Background Art

In the field of women's athletic garments, one layer pants have long been common in the field of bathing suits. Bathing suits, however, are intended to be worn in the water and as a result are normally wet during athletic activities. Women's bathing suits, particularly pants, are normally cut so as to be worn high on the sides of the wearer. As such, their use when playing out-of-water sports is ill advised since they tend to ride up causing discomfort, unsightliness and embarrassment to the wearer.

As a practical matter, all known women's athletic apparel designed specifically for non-water activities such as tennis are formed of a two layer construction, an interior cotton layer for the absorption of moisture and an exterior synthetic material for appearance. When such conventional pants construction is worn for tennis or other strenuous athletic activity out of the water, the perspiration of the wearer will become absorbed within the pants causing excessive weight. This constitutes an added burden to the athlete thereby decreasing performance. Further, the additional weight from perspiration also tends to cause the pants to fall from their intended raised position.

The inadequacies of known tennis pants and other women's athletic garments are well known and are evidenced by a large number of designs known and in commercial use. By way of example, consider U.S. Pat. No. 3,871,030 to Green which discloses a tennis panty but includes an inner cotton layer and an exterior layer of woven synthetic material. In addition, U.S. Pat. No. 2,091,441 to Hauser; U.S. Pat. No. 2,102,323 to Kneibler; U.S. Pat. No. 2,561,312 to Laszlo disclose bathing suits of a one piece construction but including cut fabric in a configuration rendering them superior for sun bathing and in-water use but unacceptable for athletic use out-of-water. In addition, U.S. Pat. No. Des. 92,392 to Dwyer and U.S. Pat. No. Des. 266,540 to Nacinovich disclose swim trunks of the boxer style. Lastly, boxer style tennis panties with ball pockets are disclosed in U.S. Pat. No. 3,744,059 to Hayes; U.S. Pat. No. 4,301,549 to Ingram; U.S. Pat. No. 4,413,762 to Carini; and U.S. Pat. No. Des. 238,828 to Reed.

The present invention is an improvement over the prior art tennis pants in that it is extremely comfortable, it wicks to move perspiration from interior of the pants adjacent to the wearer to exterior, it is extremely light weight while providing support at the appropriate locations of the wearer's body and it will not ride up during normal use.

Accordingly, it is an object of the present invention to provide athletic pants comprising in combination a plurality of basic panels extending from an upper edge at the front of the wearer's waistline, downwardly around the wearer's crotch, then upwardly to the back of the wearer's waistline and stitched together from the front waistline to the rear waistline, the basic panels being fabricated of a knit fabrication from extensible yarn; an elastic waistband coupled to the upper edge of the basic panels; a pair of support panels located interior of the basic panels and stitched thereto, the basic panels being constructed of a knit fabric from extensible yarn and with the support panels also being constructed of a knit fabric from an extensible yarn with the mesh of the support panels being of a greater elasticity than that of the basic panels; and a pair of pocket panels stitched over the sides of the base panels in an inverted U-shape configuration and with an extensible lower edge having an elastomeric hem at its lower edge thereof.

A further object of the present invention is to simplify the construction of women's tennis panties.

A further object of the present invention is to wick perspiration away from the wearer.

A further object of the present invention is to create maximum support to an athlete with minimum apparel weight.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the defined by the claims taken in conjunction with the accompanying drawings.

SUMMARY OF THE INVENTION

For the purpose of summarizing this invention, this invention may be incorporated into improved athletic pants comprising in combination a plurality of basic panels extending from an upper edge at the front of the wearer's waistline, downwardly around the wearer's crotch, then upwardly to the back of the wearer's waistline and stitched together from the front waistline to the rear waistline, the basic panels being fabricated of a knit fabrication from extensible yarn; an elastic waistband coupled to the upper edge of the basic panels; a pair of support panels located interior of the basic panels and stitched thereto, the base panels being constructed of a knit fabric from extensible yarn and with the support panels also being constructed of a knit fabric from an extensible yarn with the mesh of the support panels being of a greater elasticity than that of the basic panels; and a pair of pocket panels stitched over the sides of the base panels in an inverted U-shape configuration and with an extensible lower edge having an elastomeric hem at its lower edge thereof.

The basic panels may include three panels, one central panel and two side panels, in a panty configuration. The side panels may be of a mesh configuration. The panels may include two similarly shaped panels, with a central seam and a pair of legs, in a shorts configuration.

The invention may also be incorporated into a tennis panty comprising in combination a central panel extending from an upper edge downwardly from the wearer's waistline to between a wearer's leg and then upwardly to the back of the wearer's waistline with the central portion thereof of a reduced width; a pair of side panels having lateral edges stitched to the adjacent lateral edges of the central panel; an elastic waistband coupled to the upper edges of the central panel front and side panels; and a pair of support panels located interior of the central panel and stitched thereto, the central and side panels being constructed of a knit fabric from an extensible yarn and with the support panels also being constructed of a knit fabric from an extensible yarn with the mesh of the support panels being tighter than that of the central and side panels.

The invention may also be incorporated into a tennis panty comprising in combination a central panel knitted from elastomeric yarn extending from an upper edge downwardly from the wearer's waistline to between a wearer's leg and then upwardly to the back of the wearer's waistline with the central portion thereof of a reduced width; a pair of side panels knitted from elastomeric yarn having lateral edges stitched to the adjacent lateral edges of the central panel; an elastic waistband coupled to the upper edges of the central panel front and side panels; and a pair of pocket panels located over the side panels in an inverted U-shaped configuration but with an extensible lower edge with an elastomeric hem overhanging the lower edge of the side panels to form a pocket.

The invention may also be incorporated into a tennis panty comprising in combination a central panel extending from an upper edge downwardly from the wearer's waistline to between a wearer's leg and then upwardly to the back of the wearer's waistline with the central portion thereof of a reduced width; a pair of side panels having lateral edges stitched to the adjacent lateral edges of the central panel; an elastic waistband coupled to the upper edges of the central panel front and side panels; a pair of support panels located interior of the central panel and stitched thereto, the central and side panels being constructed of a knit fabric from an extensible yarn and with the support panels also being constructed of a knit fabric from an extensible yarn with the mesh of the support panels being tighter than that of the central and side panels; and a pair of pocket panels located over the side panels in an inverted U-shaped configuration but with an extensible lower edge with an elastomeric hem overhanging the lower edge of the side panels to form a pocket.

The invention may also be incorporated into athletic shorts comprising in combination a pair of similarly shaped basic panels extending from an upper edge at the front of the wearer's waistline, downwardly around the wearer's crotch, then upwardly to the back of the wearer's waistline and stitched together from the front waistline to the rear waistline, to form an upper waist opening and with short legs terminating at leg openings, the basic panels being fabricated of a knit fabrication from extensible yarn; an elastic waistband coupled to the upper edge of the basic panels; a pair of support panels located interior of the basic panels and stitched thereto, the base panels being constructed of a knit fabric from extensible yarn and with the support panels also being constructed of a knit fabric from an extensible yarn with the mesh of the support panels being tighter than that of the basic panels and a pair of pocket panels stitched over the sides of the base panels in an inverted U-shape configuration and with an extensible lower edge having an elastomeric hem at its lower edge thereof, spaced upwardly from the leg openings.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
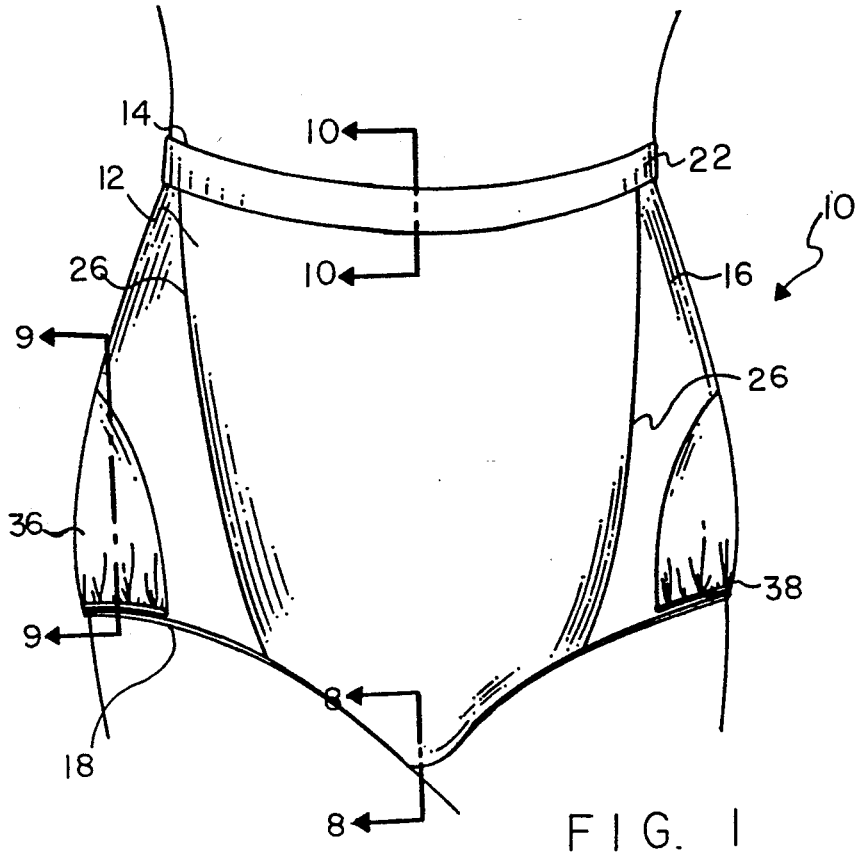
FIG. 1 is a front elevational view of tennis pants constructed in accordance with the principles of the present invention and shown on a wearer.
Figure 2:
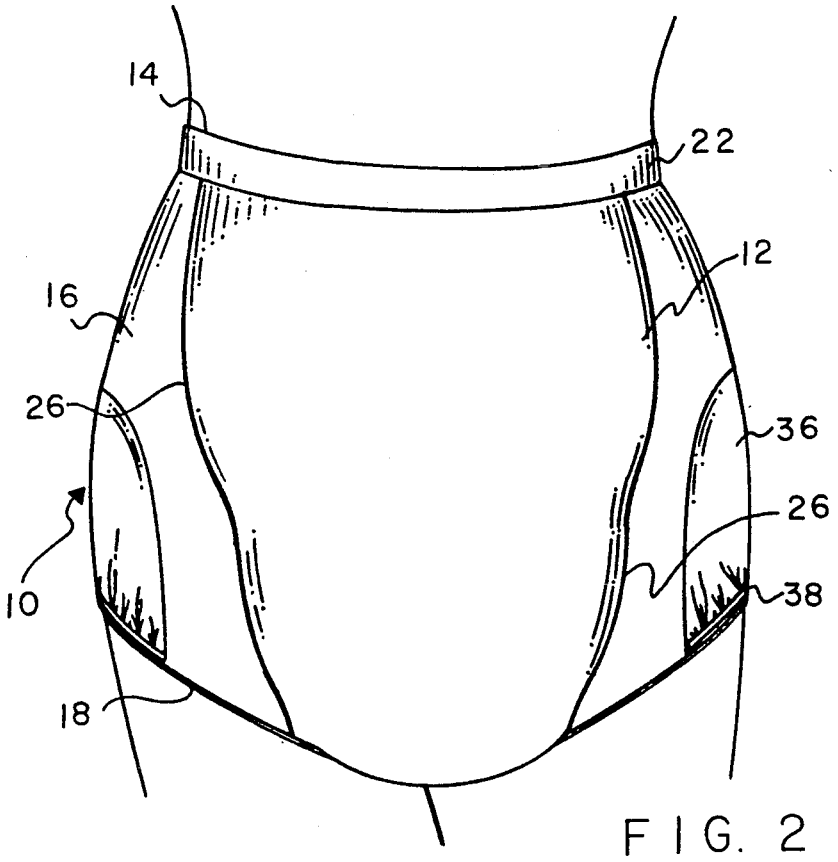
FIG. 2 is a rear elevational view of the tennis pants of FIG. 1.
Figure 3:
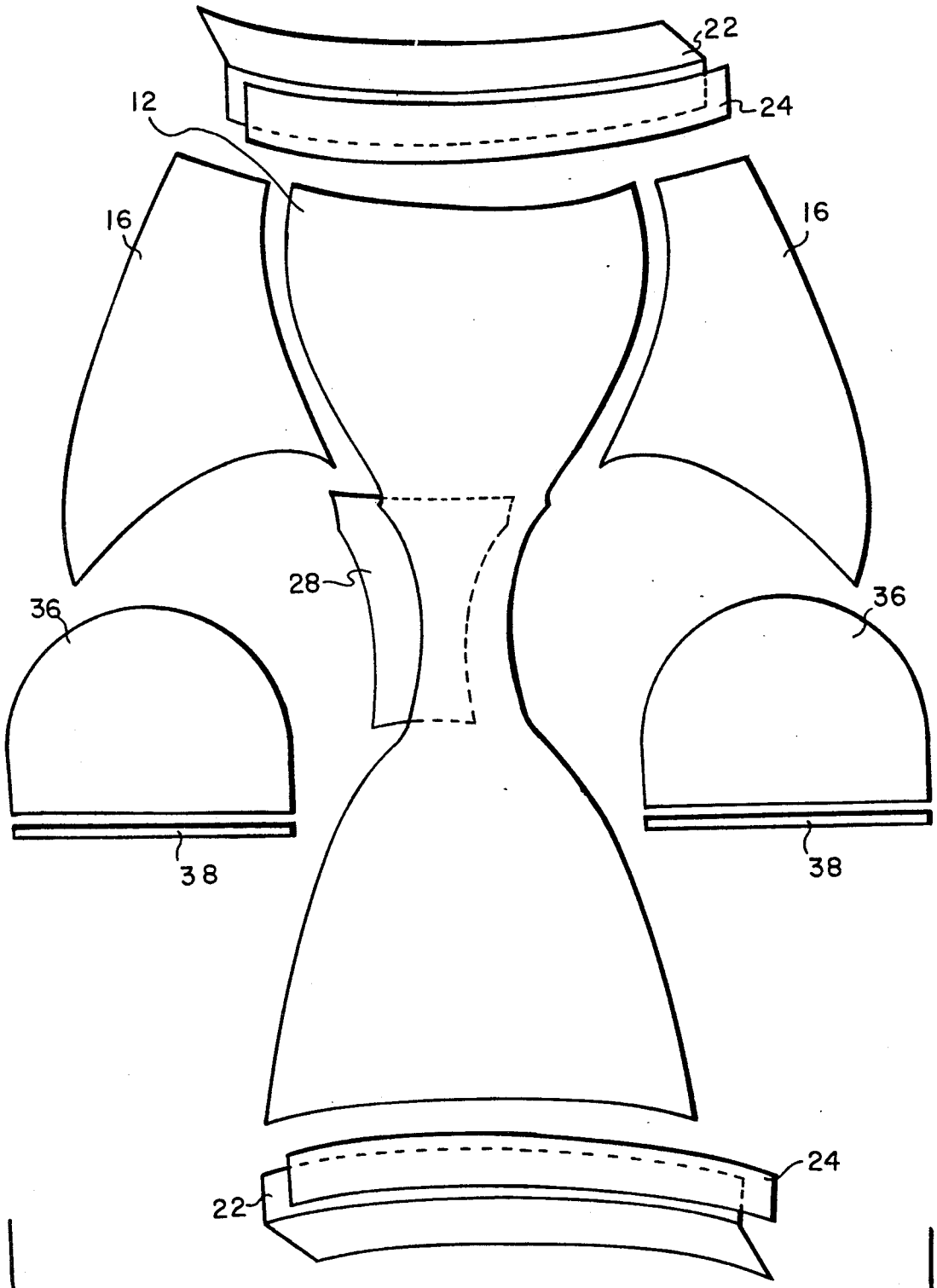
FIG. 3 is a layout illustrating the component panels of the tennis pants shown in FIGS. 1 and 2.

Shown in the various Figures, particularly FIGS. 1, 2 and 3, are tennis pants 10 constructed in accordance with the principles of the present invention and shown on a wearer. In its preferred form, the tennis pants are designed as leg-less panties for use in any out-of-water athletic activity.

The pants 10 are fabricated of a basic three piece construction with the central panel 12 in an essentially hourglass shape extending from the front of the waistline 14 of the wearer downwardly in a tapering configuration between the legs of the wearer and then back to the back of the waistline of the wearer. The reduced size between the legs is to anatomically conform to the shape of the wearer.

A pair of similarly shaped side panels 16 are also provided. The upper edges of the side panels are adapted to be located at the sides of the wearer at the waistline at a common elevational orientation with respect to the top edge, the opposed upper edges of the central panel. The side panels 16 extend downwardly to cover the sides of the hips of the wearer. The lower edges of the side panel and the lower sides of the central panel together form leg openings for the wearer with elastic hems 18. Similarly, the upper edges of the side panels and central panel together form a waist opening for the wearer.

The upper edges of the various panels are stitched to form a common elastic waistband 22 in a tunnel configuration. A loop of elastic material is formed of two stitched-together strips 24 and is located within the tunnel, stitched thereto along its length.

All of the main panels 12 and 16 of the tennis pants are fabricated of knitted yarn for flexibility. In addition, the individual yarns are of elastomeric material, preferably LYCRA brand elastic yarns for yet further elasticity of the panty. Additional materials for the yarn include LYCRA blends of SUPPLEX, COOLMAX, INTERA and cotton LYCRA, SUPPLEX, COOLMAX and INTERA are a trademark of DuPont of Wilmington, Del. LYCRA is a lightweight spandex for comfort, maneuverability, support and fit. SUPPLEX is a lightweight nylon for greater flexibility, softness, breathability, strength, quick drying and stain resistance. COOLMAX is a four channel yarn for transporting and evaporating moisture. In this manner, maximum support is provided to the wearer by the pants because of the materials and the mode of fabrication of the pants fabric.

Four vertical seams 26, two front and two back, may be observed by the wearer for the verification of the symmetric orientation of the panels on the wearer. This results in an even application of constricting forces on the wearer when properly worn as shown in FIGS. 1 and 2. The use of the materials described above is particularly beneficial since it is a wicking material and will transport perspiration from the wearer, through the fabric, to exterior of the garment to allow for more efficient evaporation of perspiration which results in lower body temperatures during play which, in turn, allows more energy to be used by the wearer during performance.

As is conventional, a crotch piece 28 of absorbent material is provided at the mid point of the central panel.

In addition to the foregoing, pockets formed from pocket panels 36 are preferably provided at the lower sides of the side panels. The pocket panels 36 are stitched in an inverted U-shaped configuration to the side panels with an elastomeric hem 38 at its lower extent located over the lower edges of the side panels thereby forming upwardly directed pockets. With the pocket opening therein, a plurality, preferably two, tennis balls may be inserted into each pocket for use by the wearer. The pockets will also hold one ball in place firmly during play, on each side for left and right-handed players. The elastomeric material of the pocket panels is the same as that of the three tennis panty panels for increased extensibility or stretchability for accommodating the balls with minimum discomfort to the wearer.

Figure 10:
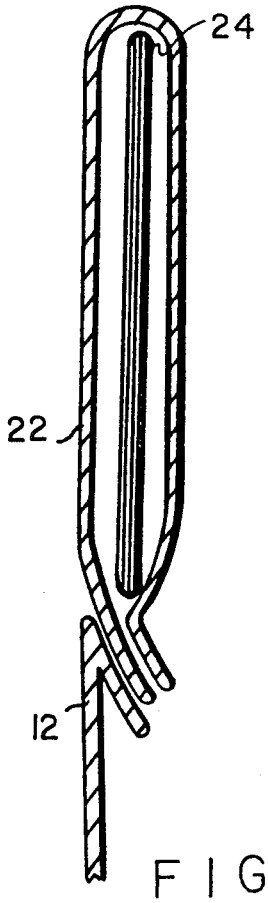
FIGS. 8, 9 and 10 are various sectional views of the pants shown in the prior Figures taken along lines 8—8, 9—9, and 10—10 of FIG. 1.
Figure 8:
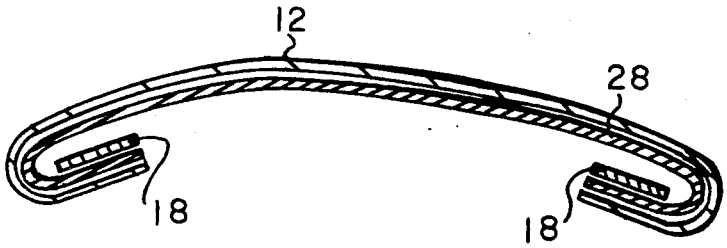
Figure 11:
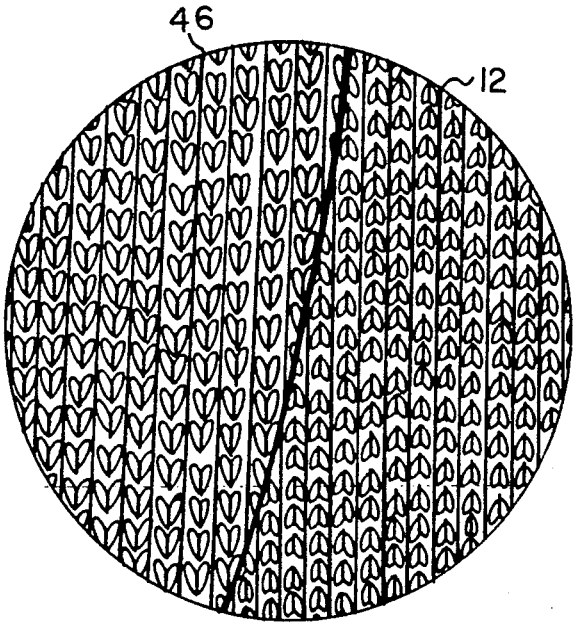
FIG. 11 is an enlarged showing of the knit pattern of the component fabric panels.
Figure 9:
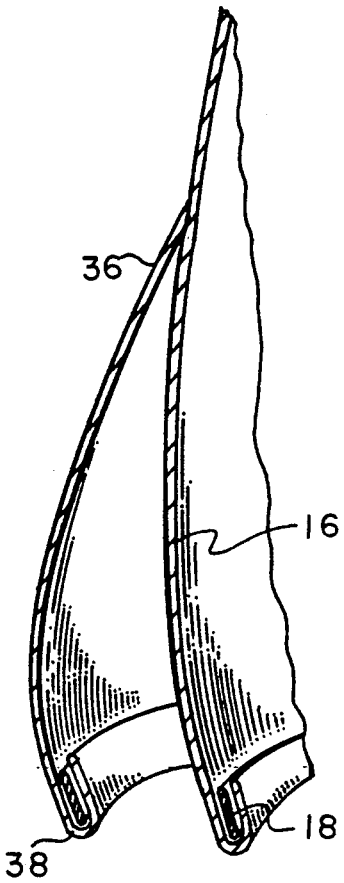

Further details of construction can be seen in FIGS. 8, 9 and 10, sectional views of the garment taken along lines 8—8, 9—9 and 10—10 of FIG. 1 as well as FIG. 11, an enlarged showing of the knit fabric comparing the central and side support panels.

Figure 4:
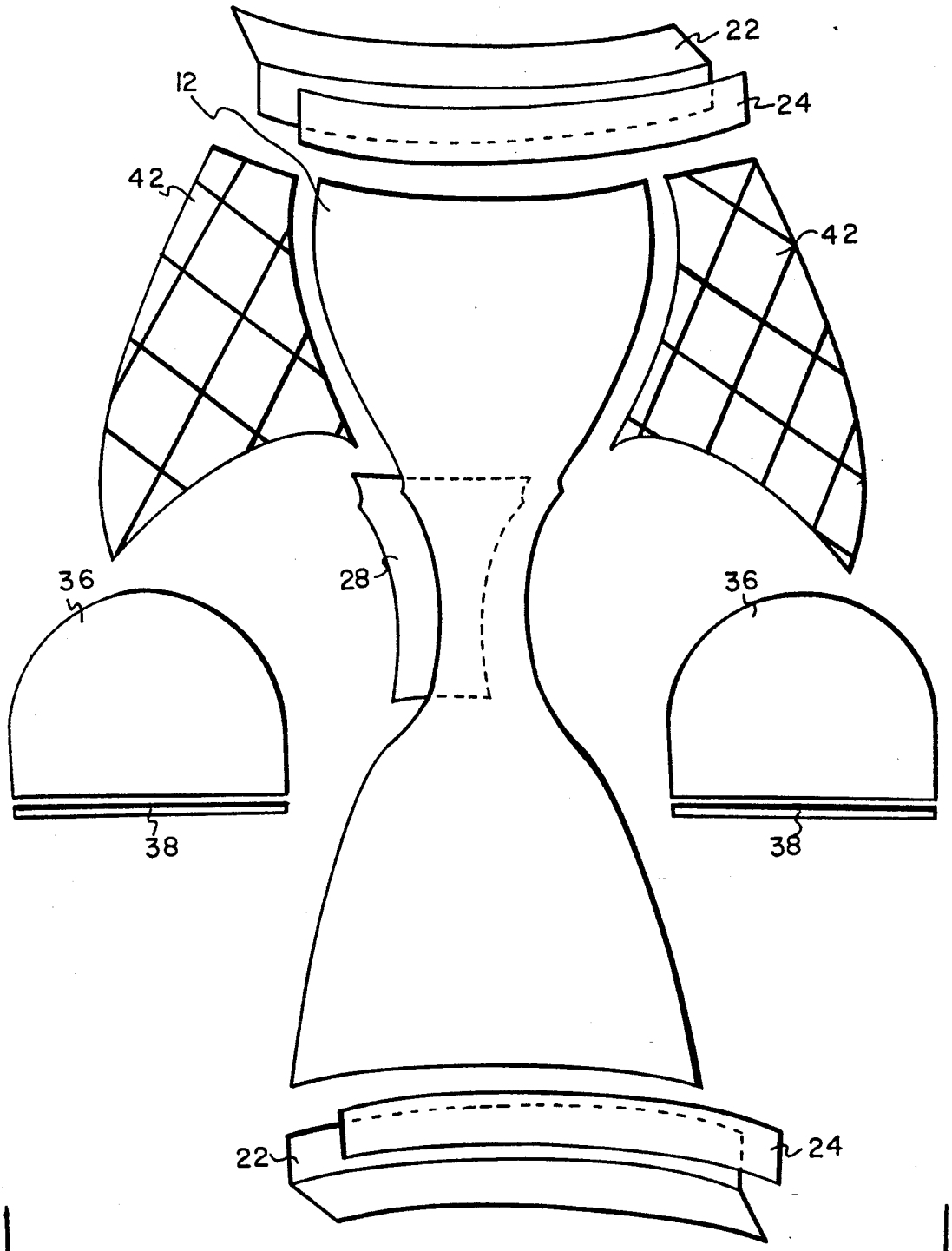
FIG. 4 is a layout similar to FIG. 3 but illustrating an embodiment wherein the side panels are of a mesh construction.

FIG. 4 illustrates a modification of the primary embodiment. In the FIG. 4 embodiment, the side panels 16 of the prior embodiment are replaced with side panels 42 of an open mesh weave. Less support is provided at the sides of the wearer, but continued strong support is provided front and back where maximum support is required.

Figure 5:
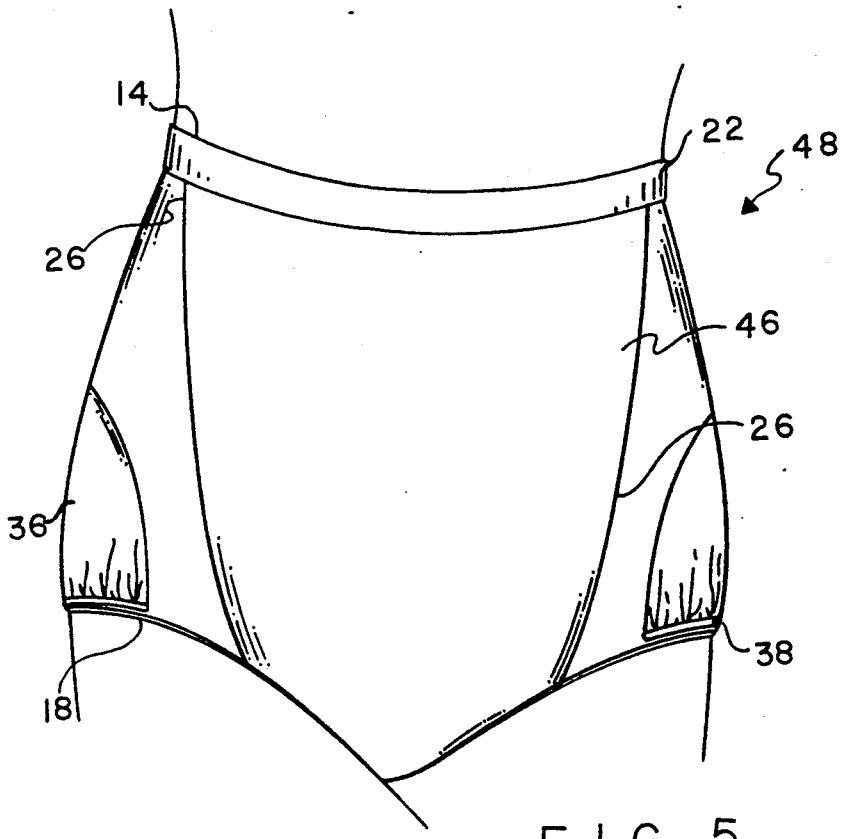
FIGS. 5, 6, and 7 are perspective illustrations and a layout similar to those of FIGS. 1, 2 and 3 but illustrating an embodiment with supplemental panels.
Figure 6:
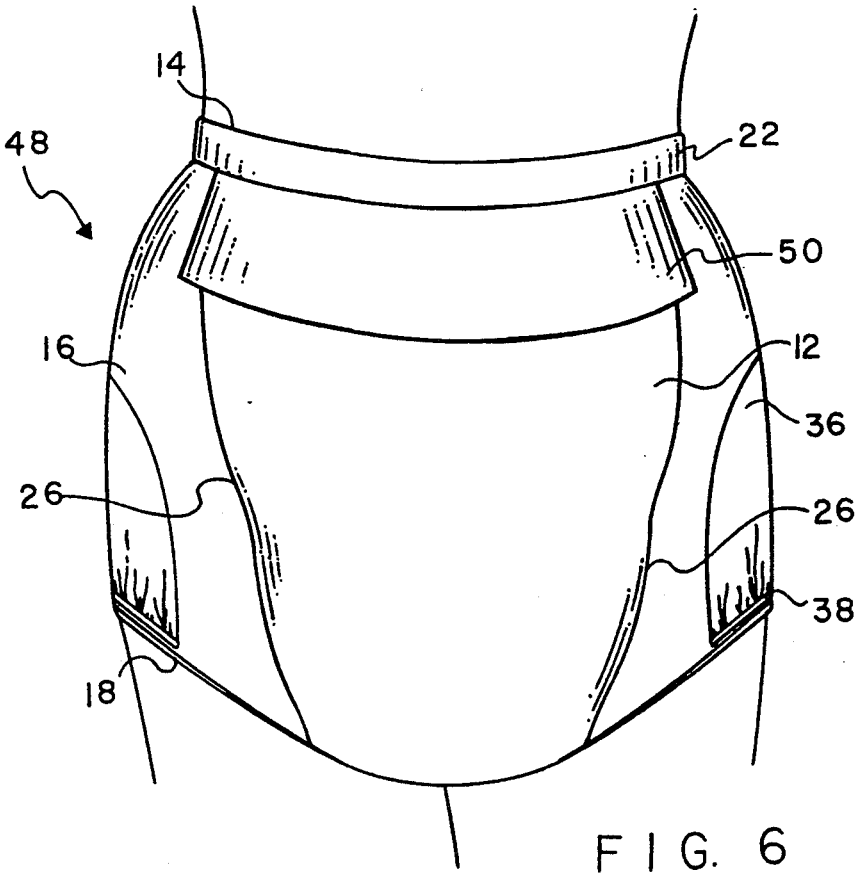
Figure 7:
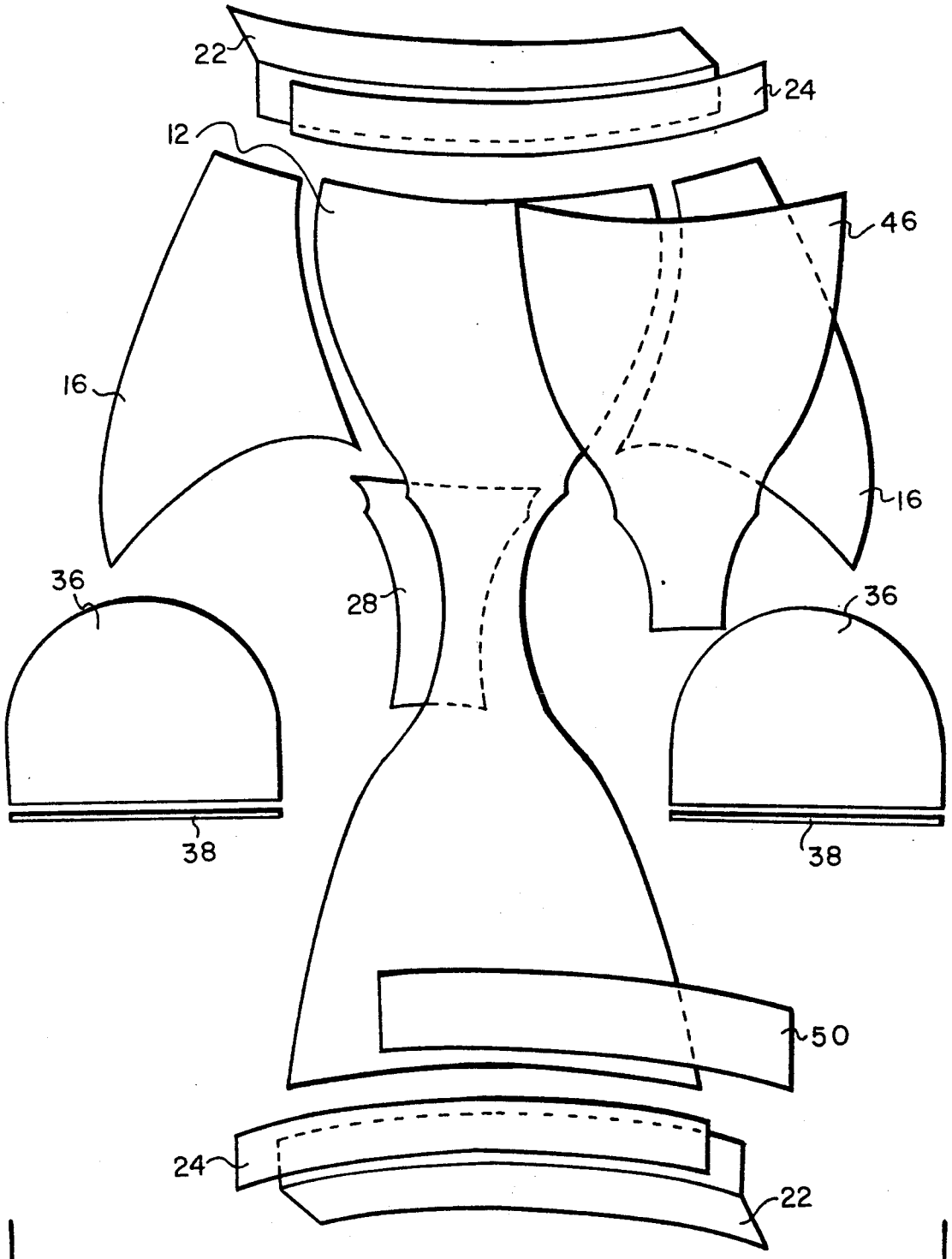

In a modified embodiment of the invention, a pair of supplemental support panels are also provided. Note FIGS. 5, 6 and 7. The first is a generally V-shaped support panel 46 extending from the front upper edge of the garment 48 downwardly to near a point above the bottom of the crotch piece. The edges of the support panel are stitched to the garment at the panels upper and lower edges as well as along generally vertical inwardly sloping lines along the front seams of the pants. A second support panel is also preferably provided. The second support panel 50 is adapted to be located in the upper back or lumbar region of the garment. It is stitched at its upper edge to the upper edge of the panty and stitched at its sides exteriorly of the sides back seams of the panty with stitching along the lower edge of the support panel. These support panels overlie the central panels of the garment.

Like the panels of the pants, these supplemental support panels are fabricated of a knitted fabric of elastomeric yarns such as those described above. It has been found, however, that by having the fabric of the supplemental support panels of a tighter knit, additional support is provided for greater comfort and support to the wearer. In the preferred embodiment, the central and side fabric panels are knitted at about 56 loops per inch in one meridian and 80 loops per inch in the other meridian. This compares to 67 stitches per inch in the one meridian and 96 loops per inch in the other meridian of the support panel fabric, a tighter mesh for the support panels by about 20 percent. Note FIG. 11.

The support panels are of a stronger elastic fabric than the main panels. By this it is meant that the support panels tend to resist deformation to a greater degree than the main panels upon the application of force and they also tend to return to their original shape more quickly and more completely upon the removal of the force. The varying elasticity of the fabric may be achieved by various other techniques including the use of yarns of different elasticity or different knit patterns of different yarns or blends.

Figure 12:
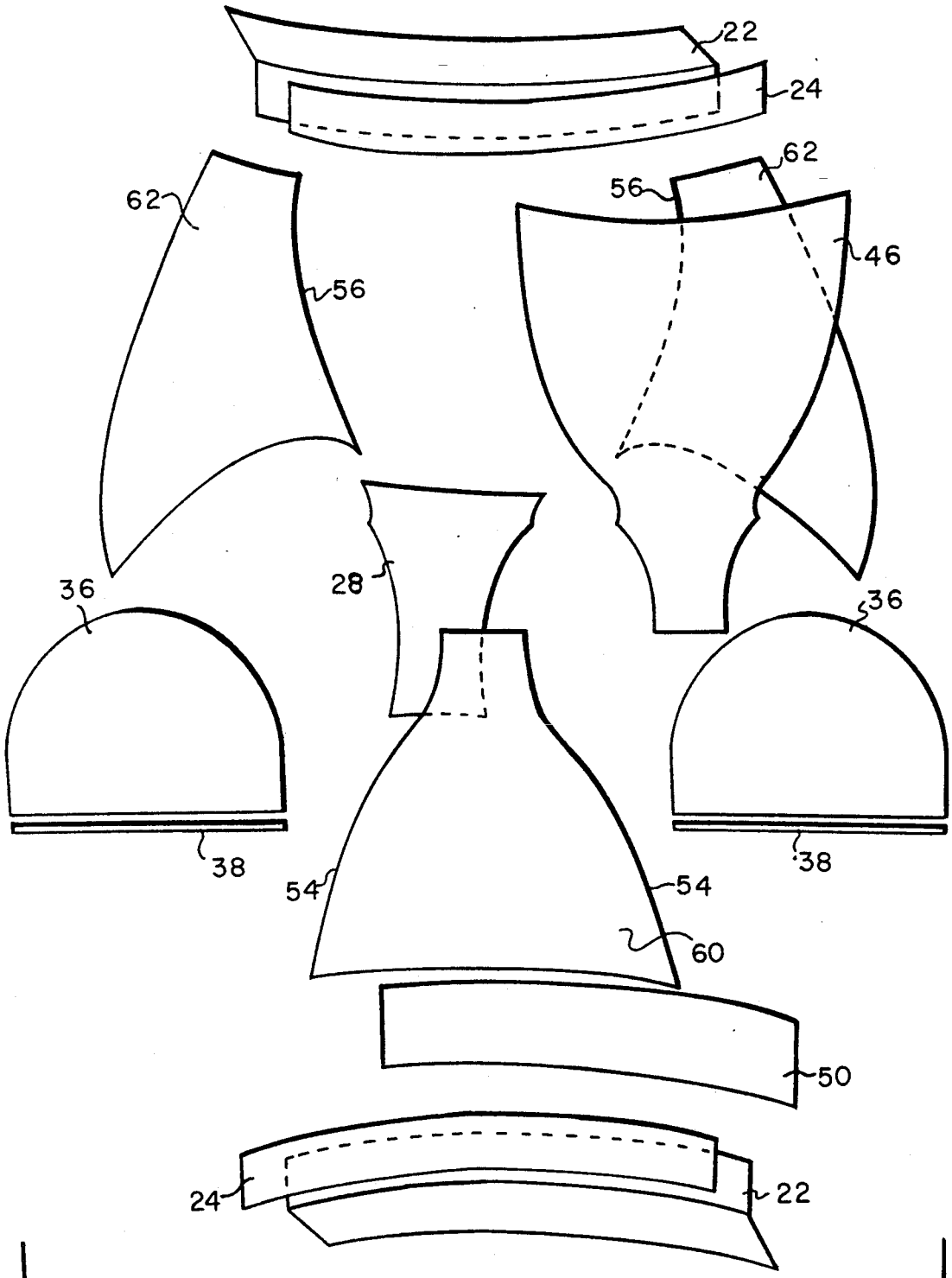
FIG. 12 is a pattern layout similar to FIG. 7 but illustrating a one-layer construction in the support areas.

In the variation as shown in FIG. 12, the supplemental support panels 46 and 50 are not superposed over the central and side panels 12 and 16. They are stitched along their edges to cut out edges 54 and 56 in the basic panels 60 and 62. As a result, the entire FIG. 12 garment, except for a crotch piece, is one layer thick, rather than the two layers of the prior embodiment.

Figure 13:
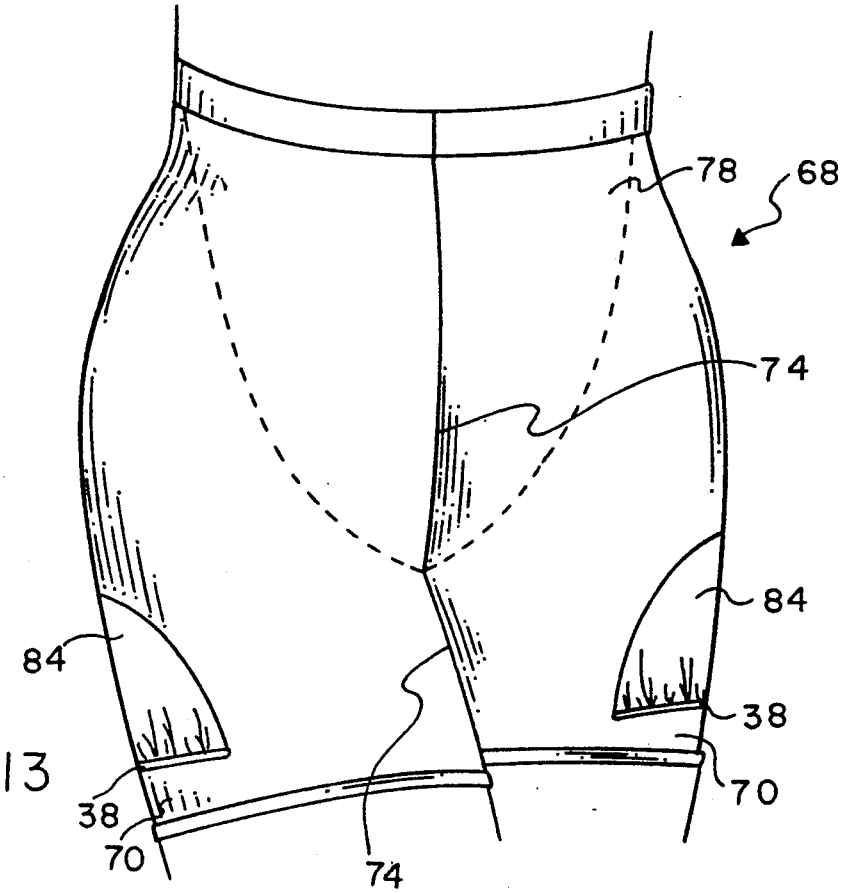
FIGS. 13 and 14 are perspective illustrations of the athletic pants constructed in accordance with an alternate embodiment of the invention and shown on a wearer.
Figure 14:
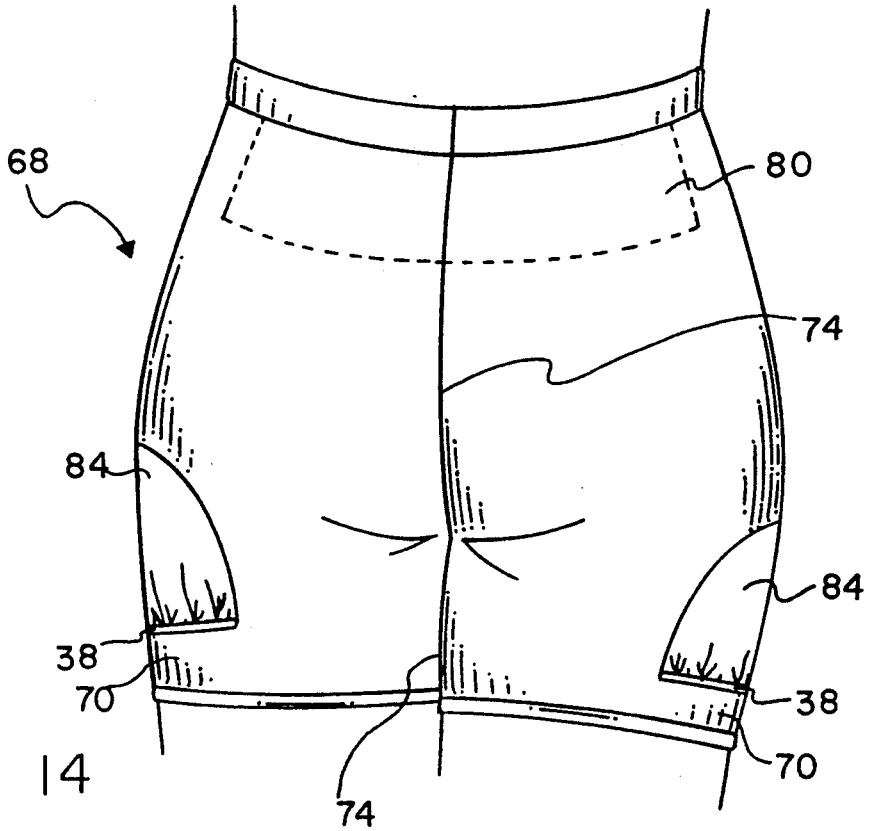
Figure 15:
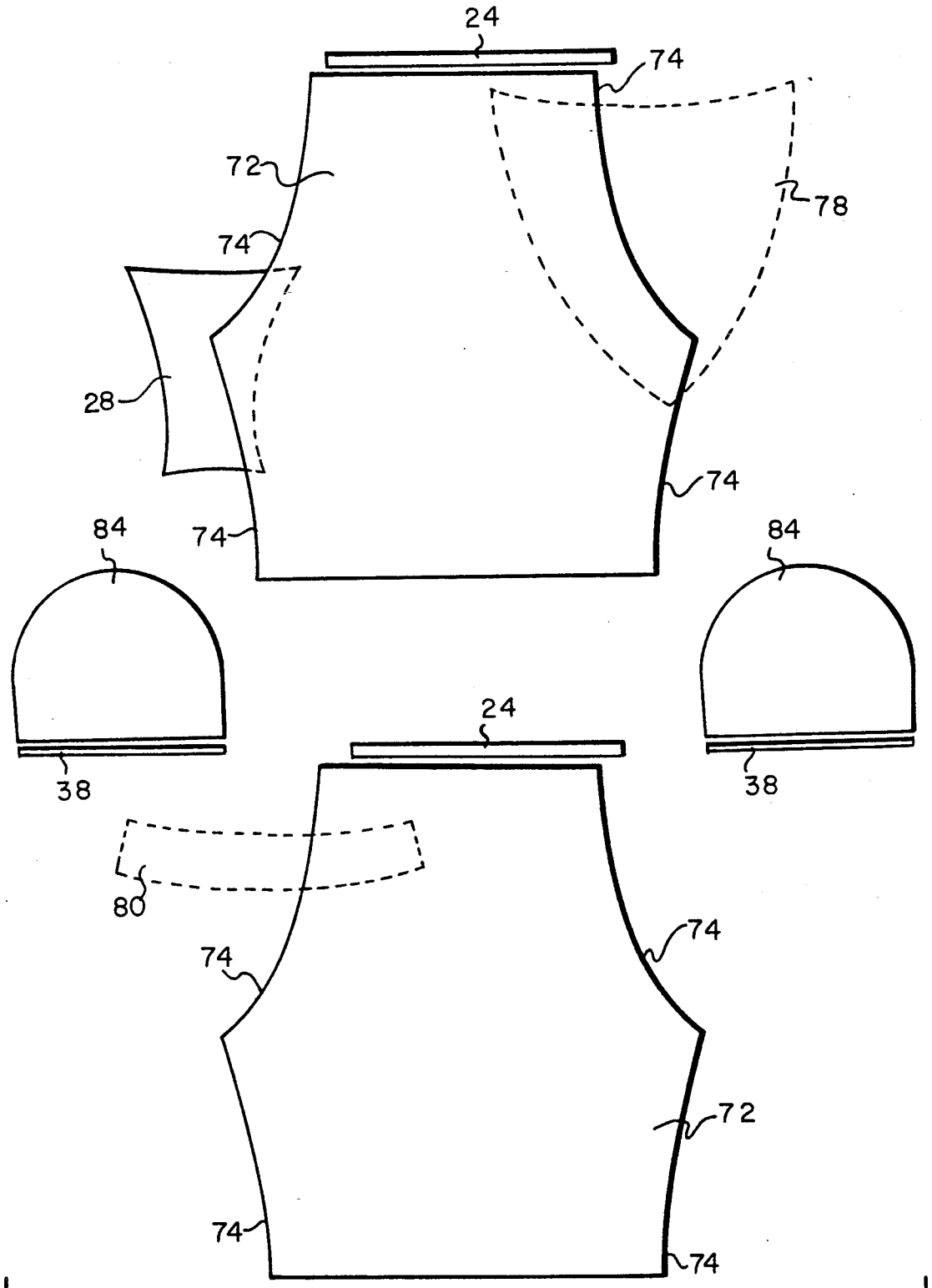
FIG. 15 is a layout illustrating the component panels of the athletic pants shown in FIGS. 13 and 14.

In a further alternate embodiment of the invention, that of FIGS. 13, 14 and 15, the pants 68 are formed as shorts or tights with legs 70 formed as tubular extensions extending downwardly along the thighs of the wearer. In this further alternate embodiment, the fabric is formed of two cut pieces 72 with seams 74 vertically along a center line from the upper edge at the waist opening down through the crotch and back upwardly to the upper edge of the waist opening and also along the interiors of the legs. As in the prior embodiment, the fabric is a knit fabric formed from extensible yarns with the knit of the material as described with regard to the primary embodiment hereinabove. And as in the primary embodiment, supplemental body supporting panels 78 and 80 are preferably provided front and rear. The front support panel is in a generally v-shaped configuration extending downwardly from the waistband to the crotch piece. The back support panel is formed of a generally rectangular shaped piece stitched to the interior of the panels extending across the lumbar region.

As in the primary embodiment, the support panels are also fabricated of a knit fabric from extensible yarn with a tighter mesh than that of the basic fabric panels, and the support panels may be stitched into cutouts of the main panels rather than formed to lie over the main panels as shown.

Lastly, as in the primary embodiment, pockets are formed on the sides of the shorts from a pair of pocket panels 84. The pocket panels are in an inverted U-shaped configuration whereat they are stitched to the fabric of the main panels with an elastic hem at their lower edge, similar to the primary embodiment, but spaced upwardly from the lower edge of the garment.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. Athletic pants comprising in combination:

basic panel means having an upper front edge, an upper rear edge and sides, the basic panel means extending from the upper front edge at the front of the wearer's waistline, downwardly around the wearer's crotch, then upwardly to the upper rear edge at the back of the wearer's waistline with generally vertical stitching to couple the panel means together, the basic panel means being fabricated of a knit fabric from extensible yarn;

an elastic waistband coupled to the upper front and rear edges of the basic panel means;

a pair of support panels with lateral edges, the support panels having upper edges extending downwardly from the upper front edge and upper rear edge and stitched at their lateral edges to the basic panel means, the basic panel means being constructed of a knit fabric from extensible yarn and with the support panels also being constructed of a knit fabric from an extensible yarn, the fabric of the basic panel means being of a first mesh and the fabric of the support panels being of a second mesh with the second mesh of the support panels being of a greater elasticity than that of the basic panels means; and a pair of pocket panels stitched over the sides of the basic panel means, the pocket panels being shaped in an inverted U-shape configuration and with an extensible lower edge having an elastomeric hem at its lower edge thereof to cooperate with the basic panel means to form a pocket opening.

2. The pants as set forth in claim 1 wherein the basic panel means include three panels, one central panel with lateral edges between the upper front and rear edges and two side panels with lateral edges stitched to the lateral edges of the central panel in a panty configuration.

3. The pants as set forth in claim 2 wherein the central panel and side panels are of the same mesh configuration.

4. The pants as set forth in claim 1 wherein the basic panel means include two identically shaped panels with a central seam therebetween extending between the upper front and rear edges and forming a pair of legs in a shorts configuration.

5. A tennis panty comprising in combination:

a central panel having an upper front edge and an upper rear edge, the central panel extending from the upper front edge at the front of a wearer's waistline to between a wearer's leg and then upwardly to the upper rear edge at the back of the wearer's waistline with the central portion thereof of a reduced width and with lateral edges;

a pair of side panels having lateral edges stitched to the lateral edges of the central panel;

an elastic waistband coupled to the upper front and rear edges of the central panel; and a pair of support panels with lateral edges, the support panels having upper edges extending downwardly from the upper front edge and upper rear edge and stitched at their lateral edges to the central panel, the central and side panels being constructed of a knit fabric from an extensible yarn and with the support panels also being constructed of a knit fabric from an extensible yarn, the support panels being fabricated of a fabric having a tighter mesh than that of the central and side panels.

6. A tennis panty comprising in combination:

a central panel knitted from elastomeric yarn and having an upper front edge and an upper rear edge and a central portion therebetween, the central panel extending from the upper front edge at the wearer's waistline to between a wearer's leg and then upwardly to the upper rear edge at the back of the wearer's waistline with the central portion thereof of a reduced width and with lateral edges;

a pair of side panels knitted from elastomeric yarn and having lateral edges stitched to the lateral edges of the central panel, the central and side panels being fabricated of a fabric having a first mesh;

an elastic waistband coupled to the upper edges of the central panel and front and side panels; and a pair of pocket panels fabricated of an elastomeric fabric located over the side panels in an inverted U-shaped configuration with an extensible lower edge with an elastomeric hem located adjacent to the lower edge of the side panels to form therewith a pocket.

7. A tennis panty comprising in combination:

a central panel having an upper front edge and an upper rear edge, the central panel extending from an upper front edge downwardly from the wearer's waistline to between a wearer's leg and then upwardly to the upper rear edge at the back of the wearer's waistline with the central portion thereof of a reduced width and having lateral edges;

a pair of side panels having lateral edges stitched to the lateral edges of the central panel;

an elastic waistband coupled to the upper edges of the central panel front and side panels;

a pair of support panels with lateral edges and extending downwardly from the upper front edge and upper rear edge and stitched at their lateral edges to the basic panel means, the central and side panels being constructed of a knit fabric from an extensible yarn and with the support panels also being constructed of a knit fabric from an extensible yarn and having a mesh which is tighter than the mesh of the central and side panels; and a pair of pocket panels fabricated of a fabric located over the side panels in an inverted U-shaped configuration but with an extensible lower edge with an elastomeric hem located adjacent to the lower edge of the side panels to form a pocket.

8. Athletic shorts comprising in combination:

a pair of identically shaped basic panels having upper front edges and upper rear edges, the basic panels extending from the upper edge at the front of the wearer's waistline, downwardly around the wearer's crotch, then upwardly to the upper rear edge at the back of the wearer's waistline and stitched together to couple the upper front and rear edges at the front waistline and the rear waistline, to form an upper waist opening and with short legs terminating at leg openings, the basic panels being fabricated of a knit fabric from extensible yarn;

an elastic waistband coupled to the upper front and rear edges of the basic panels;

a pair of support panels with lateral edges, the support panels extending downwardly from the upper front edge and upper rear edge and stitched at their lateral edges to the basic panels the base panels being constructed of a knit fabric from extensible yarn having a first mesh and with the support panels also being constructed of a knit fabric from an extensible yarn with a second mesh, the second mesh of the support panels being tighter than the first mesh of the basic panels; and a pair of pocket panels formed of a fabric stitched over the sides of the basic panels in an inverted U-shape configuration and with an extensible lower edge having an elastomeric hem at its lower edge thereof, spaced upwardly from the lower edge of the leg openings.

9. Athletic pants comprising in combination:

basic panel means having an upper front edge, an upper rear edge and sides, the basic panel means extending from the upper front edge at the front of the wearer's waistline, downwardly around the wearer's crotch, then upwardly to the upper rear edge at the back of the wearer's waistline with generally vertical stitching to couple the panel means together, the basic panel means being fabric knit from extensible yarn;

an elastic waistline coupled to the upper front and rear edges of the basic panel means; and a pair of pocket panels stitched over the sides of the basic panel means, the pocket panels being shaped in an inverted U-shape configuration and with an extensible lower edge having an elastomeric hem at its lower edge thereof to cooperate with the basic panel means to form pocket openings, the pockets being of sufficient size to receive two tennis balls.

10. Athletic pants comprising in combination:

basic panel means having an upper front edge, an upper rear edge and sides, the basic panel means extending from the upper front edge at the front of the wearer's waistline, downwardly around the wearer's crotch, then upwardly to the upper rear edge at the back of the wearer's waistline and coupled with generally vertical stitching to couple the panel means together, the basic panel means being fabric knit from extensible yarn;

an elastic waistband coupled to the upper front and rear edges of the basic panel means; and at least one pocket panel fabricated from a fabric of extensible yarn, the pocket panel being in an inverted U-shaped configuration and stitched to the basic panel means, the pocket panel having a lower edge which, with the basic panel means, forms an opening.

* * * * *